US005924252A

United States Patent [19]

Deike

[11] Patent Number: 5,924,252

[45] Date of Patent: Jul. 20, 1999

[54] FLOORING SHEET MATERIAL

[75] Inventor: Hans-Detlef Deike, Bad Laer, Germany

[73] Assignee: Bostik Incorporated, Wilmington, Del.

[21] Appl. No.: 08/863,058

[22] Filed: May 23, 1997

[30] Foreign Application Priority Data

May 24, 1996 [DE] Germany ..... 296 09 329

[51] Int. Cl.[6] ..... E04F 15/18

[52] U.S. Cl. ..... 52/390; 52/391; 52/408; 52/409; 52/411; 52/747.11; 52/DIG. 16

[58] Field of Search ..... 52/390, 391, 408, 52/409, 411, 747.11, DIG. 16

[56] References Cited

U.S. PATENT DOCUMENTS 3,121,649 2/1964 Oliver ..... 52/DIG. 16 X
3,468,086 9/1969 Warner ..... 52/DIG. 16 X
5,085,022 2/1992 Paliwoda ..... 52/409 X
5,137,764 8/1992 Doyle et al. ..... 52/411 X
5,564,251 10/1996 Van Beers ..... 52/747.11

*Primary Examiner*—Christopher Kent
*Attorney, Agent, or Firm*—David G. Conlin; Peter F. Corless; Dike, Bronstein, Roberts, & Cushman, LLP

[57] ABSTRACT

A sheet is provided which can be applied to a planar base and onto which floor boards or tiles can laid, wherein the sheet comprises adhesive strips on its lower and upper sides. The adhesive strips are suitably applied in the longitudinal direction of the sheet. In an preferred aspect, two layers are fixedly connected to one another, a top layer comprising a foamed plastic having a high coefficient of sound insulation and a bottom layer comprising a vapor-tight material and an edge formed by a protruding bottom layer which may be provided on one longitudinal side.

10 Claims, 1 Drawing Sheet

FLOORING SHEET MATERIAL

The present invention relates to a sheet, which can be applied to a planar base and onto which floor boards or tiles, which can be connected to one another and are made of wood, wood-like material or plastic, can be laid.

BACKGROUND

A sheet of this kind is applied in order to achieve better sound insulation, in particular better footstep and room sound insulation.

A foamed sheet is preferably used for this purpose.

Normally, this sheet is either laid loosely or is fixed to the base by means of an adhesive applied over the entire underside.

The floor boards or tiles, which may, for example, comprise parquet blocks or laminated floor, can then be placed loosely on the sheet and connected to one another, for example in the form of tongue-and-groove connections.

However, cavities may form in regions beneath the floor laid in this manner, either due to unevenness of the base or due to distortion of the floor boards, so that no footstep sound insulation is provided in these regions.

This manifests itself acoustically by clicking noises when the floor is walked on.

Noise of this kind is considered extremely disruptive, in particular in tenement blocks, since the occupants of adjacent flats are also affected as a result.

SUMMARY OF THE INVENTION

The object underlying the present invention is therefore to configure a sheet of the generic type such that it can be laid simply and sound insulation of the floor situated thereon is ensured in all cases.

This object is achieved by means of a sheet which is characterized in that it has adhesive strips on its lower and upper sides.

Due to the fact that the sheet has adhesive strips applied on the operative side, it is firstly considerably simpler to lay the sheet, with the result that the overall laying costs are reduced.

Since the floor boards are now also fixed on the upper side, in practice it is no longer possible for cavities to form between the sheet and the floor boards. The thickness of the adhesive strips, which are known per se, is in this case so small as to be negligible with regard to the distance between the underside of the floor and the upper side of the sheet.

The adhesive strips applied to both operative sides of the sheet are provided with a cover strip, which is removed from the adhesive strip when the sheet is applied to the base or when the floor boards are laid, for the purpose of easier manipulation of the sheet.

For production purposes, it is sensible to apply the adhesive strips in the longitudinal direction of the sheet, it being possible to select different distances between the parallel adhesive strips depending on the dimensions of the floor boards to be applied.

In accordance with an advantageous configuration of the invention, it is envisaged for the sheet to be of two-layer design, one layer being formed by the foamed insulating sheet and the other layer by a vapour-tight layer, which preferably forms the underside of the sheet.

An edge formed by the protruding bottom layer may be provided on one longitudinal side. An adhesive strip, which extends in the longitudinal direction, may be likewise provided in the upper edge region formed by the bottom layer.

According to another configuration, the top layer and the bottom layer, viewed in the transverse direction, rest on one another in a manner offset from one another so that, on the one hand, the bottom layer protrudes beyond the top layer and, on the other hand, the top layer protrudes beyond the bottom layer.

BRIEF DESCRIPTION OF THE DRAWINGS

An exemplary embodiment of the invention will be described below with reference to the appended drawings, in which.

DETAILED DESCRIPTION OF THE INVENTION

Figure 2:
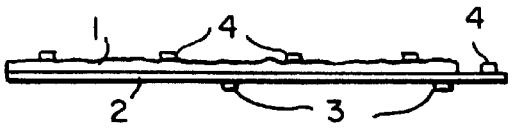
FIG. 2 shows a cross-section through the sheet.
Figure 1:
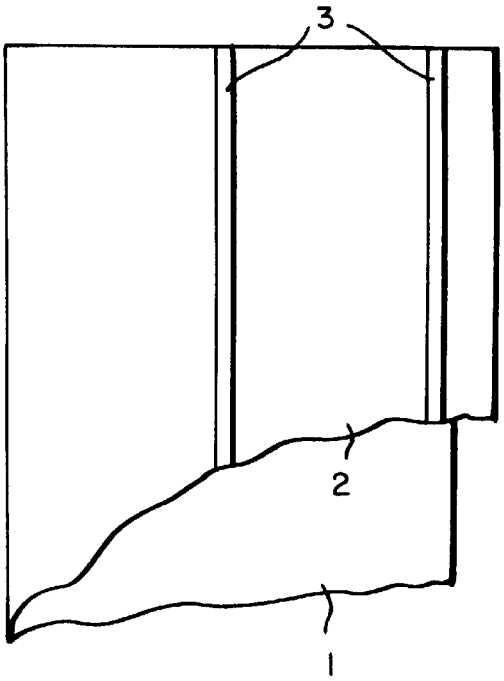
FIG. 1 shows a bottom view of the sheet according to the invention.
Figure 3:
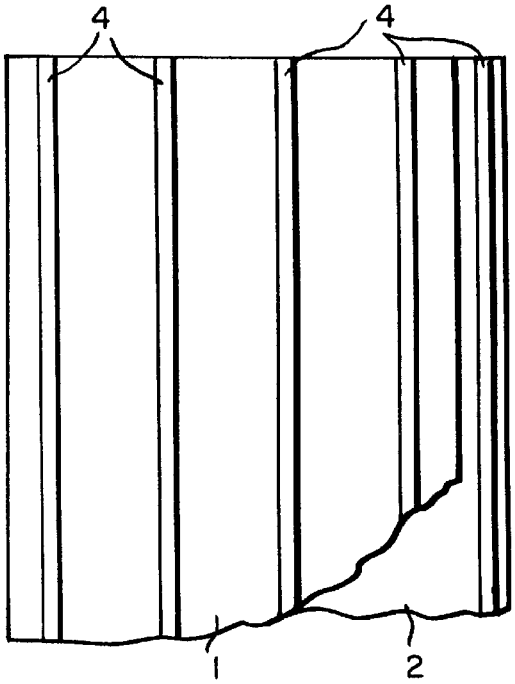
FIG. 3 shows a top view of the sheet.

The figures illustrate a sheet which comprises two layers which are fixedly connected to one another. One of these layers forms a top layer 1, which is produced from a foamed plastic and has a sound-insulating effect.

The second layer is formed by a vapour-tight bottom layer 2, which can be laid on a building-side base.

Both the bottom layer 2 and also the top layer 1 are provided with adhesive strips 3, 4, which run parallel to and at a distance from one another in the longitudinal direction and before use have been covered with a removable protective film. The sheet can be fixed to the base by means of the adhesive strips 3, which are fixed on the bottom layer 2. A lesser number of adhesive strips 3 are sufficient for this purpose than on the top layer forming the upper side of the sheet.

These adhesive strips 4 are arranged at a narrower distance from one another, so that floor boards or tiles to be laid are joined to the sheet in a completely fixed manner.

In the longitudinal-side overlap region of two adjacent webs of sheet, the top layer 1 does not run right to the edge on one longitudinal side, so that the bottom layer protrudes laterally.

An adhesive strip 4 is likewise provided in this region, but in this case is connected to the bottom layer 2.

The bottom layer 2 of the adjacent sheet is laid on this recessed edge region and adhesively bonded to the adhesive strip 4. As a result, vapour-tightness is also ensured in this region.

However, it is also conceivable, in contrast to the exemplary embodiment shown, in which the top layer is narrower than the bottom layer, for the top layer 1 and bottom layer 2 to be of equal width and merely to rest on one another in a manner offset from one another, so that during application the protruding edge of the top layer 1 of a web of sheet rests on the protruding edge of the bottom layer 2 of the adjacent web of sheet.

What is claimed is:

1. A flooring sheet which can be applied to a planar base and onto which flooring boards or tiles, which can be connected to one another and are made of wood, wood-like material or plastic, can be laid, the sheet comprising adhesive strips on its lower and upper sides.

2. A flooring sheet according to claim 1 wherein the adhesive strips run parallel to and at a distance from one another in a longitudinal direction of the sheet.

3. A flooring sheet according to claim 1, wherein a top layer and a bottom layer are fixedly connected to one another, the top layer comprising a foamed plastic having a high coefficient of sound insulation and the bottom layer comprising a vapor-tight material.

4. A flooring sheet according to claim 3, wherein an edge formed by the bottom layer is provided on one longitudinal side.

5. A flooring sheet according to claim 4, wherein an adhesive strip, which extends in a longitudinal direction, is likewise provided in an upper edge region formed by the bottom layer.

6. A flooring sheet according to claim 3, wherein the top layer and the bottom layer, viewed in a transverse direction, rest on one another in a manner offset from one another, whereby the bottom layer protrudes beyond the top layer and, the top layer protrudes beyond the bottom layer.

7. A flooring system, comprising:

a sheet comprising adhesive strips on its lower and upper sides, the sheet lower side applied over a planar base, and flooring boards or tiles laid over the sheet top side.

8. The flooring system of claim 7 wherein the floor board or tiles are made of wood or plastic.

9. The flooring system of claim 7 wherein the sheet is a foamed sheet.

10. The flooring system of claim 7 wherein flooring boards or tiles are parquet blocks or laminated floor.

* * * * *